US006168509B1

(12) United States Patent
Presgrove

(10) Patent No.: US 6,168,509 B1
(45) Date of Patent: Jan. 2, 2001

(54) MANUAL KNIFE SHARPENING DEVICE

(76) Inventor: S. Brock Presgrove, P.O. Box 1010, Evans, GA (US) 30809

( * ) Notice: Under 35 U.S.C. 154(b), the term of this patent shall be extended for 0 days.

(21) Appl. No.: 09/443,029

(22) Filed: Nov. 18, 1999

Related U.S. Application Data

(63) Continuation-in-part of application No. 09/036,624, filed on Mar. 7, 1998.

(51) Int. Cl.[7] ..... B24D 17/00
(52) U.S. Cl. ..... 451/552; 451/371
(58) Field of Search ..... 451/45, 65, 540, 451/552, 555, 556, 558, 174, 175, 170, 371

(56) References Cited

U.S. PATENT DOCUMENTS 3,874,120 * 4/1975 Dalton et al. ..... 51/59 R
3,883,995 * 5/1975 Ohashi ..... 51/91 BS
4,216,627 * 8/1980 Westrom ..... 51/69
4,231,194 * 11/1980 Glesser ..... 51/211 R
4,259,815 * 4/1981 Kuban ..... 51/205 R
4,320,892 * 3/1982 Longbrake ..... 269/3
4,450,653 * 5/1984 Fletcher ..... 51/211 R
4,528,777 * 7/1985 Bernstein et al. ..... 51/40
4,530,188 * 7/1985 Graves ..... 51/214
4,567,693 * 2/1986 Magnuson ..... 51/3
4,602,531 * 7/1986 Korhonen ..... 76/82
4,627,194 * 12/1986 Friel ..... 51/58
4,640,058 * 2/1987 Glesser ..... 51/211 R
4,719,722 * 1/1988 Washburn ..... 51/205 R
4,759,153 * 7/1988 Cohen ..... 51/211 R

* cited by examiner

*Primary Examiner*—Timothy V. Eley
*Assistant Examiner*—Dung Van Nguyen
(74) *Attorney, Agent, or Firm*—Michael Mann

(57) ABSTRACT

A knife sharpener having a clamp system held by a frame in such a way that the knife to be sharpened may move in any direction freely but is otherwise held so that it does not rotate about any axis through the knife in order to maintain its orientation with respect to sharpening stones held by the frame. The knife can therefore be sharpened by moving it toward the user and down, first against one of two stones and then against the other, opposing stone, to sharpen both sides of the blade. The sharpener can be attached to a base or to the underside of cabinetry and may be used with various sharpening stones. In particular, a triangular, pivoting stone with rounded corners is preferred because it offers different facets and curves for use in sharpening flat-bladed and serrated knives and fully engages the knife blade through to the tip as the blade is drawn across its surface.

23 Claims, 8 Drawing Sheets

MANUAL KNIFE SHARPENING DEVICE

This application is a continuation in part of a co-pending parent application, Ser. No. 09/036,624, filed Mar. 7,1998.

FIELD OF INVENTION

This invention relates to knife sharpening devices.

BACKGROUND OF THE INVENTION

In order to sharpen a knife, the blade has to be drawn across the surface of and in contact with a sharpening stone while maintaining a desired angle between the stone and the blade. Maintaining the desired angle while the blade is drawn across the stone by hand with no mechanical assistance has been the most difficult part of the task.

Currently there are several devices which use mechanical assistance to sharpen knifes. U.S. Pat. No. 4,216,627 to Westrom (1980) and U.S. Pat. No. 4,320,892 to Longbrake (1982) describe devices for sharpening a knife blade that keep the blade stationary as a sharpening stone is drawn across the blade at a predetermined angle. Once the stone is drawn from the base to the tip of the blade, the blade has to be rotated 180° so the stone can be drawn across the opposite side of the blade, again, at the pre-determined angle. The process is repeated until it produces a sharp blade at a precise angle. Unfortunately, repeating this action the number of times necessary to obtain a sharp edge is time consuming and the process is cumbersome.

U.S. Pat. No, 4,602,531 to Korhonen (1986) teaches a system that mounts the apparatus that holds the knife upon a surface. The apparatus that holds the sharpening stones is mounted to a different surface opposite to and in proximity of the knife holding apparatus. To operate the device, the stones are positioned at a selected elevation. The knife blade is then positioned until one side of the blade edge comes in contact with one of the stones. The knife blade is then drawn across the stone at a constant elevation. All operations are done with pistons. Positioning the stones and the blade, and drawing the blade across the stones are all separate, sequential steps requiring the use of the pistons. Operation is intricate and done with instruments and controls. Pressurized hydraulics or pneumatics is required and the device has to be permanently mounted to two opposing surfaces.

U.S. Pat. No. 4,530,188 to Graves (1985) describes the use a base designed to receive one end of sharpening sticks inserted into holes formed in the base at a predetermined angle. The user draws the knife across the stick while attempting to maintain a specific angle between the blade and the sticks. It is difficult to hold the angle manually. In addition, stones that are held in place by inserting one end of the stone into holes formed in a base create a cantilever beam. Upon use, the slots become enlarged which changes the predetermined angle at which the sticks are held. In some cases, the hole becomes so enlarged that the stones can not be held in place or the stone brakes at the point of contact with the base.

U.S. Pat. No. 3,874,120 to Dalton (1975), U.S. Pat. No. 3,883,995 to Ohashi (1975), U.S. Pat. No. 4,528,777to Bernstein (1985), U.S. Pat. No. 4,567,693 to Magnuson (1986) and U.S. Pat. No. 4,627,194 to Friel all describe the use gears and motors to control the process. They are all external power supply dependent and require numerous alignments prior to use.

Thus there remains a need for an effective way to sharpen a knife manually.

SUMMARY OF THE INVENTION

According to its major aspects and briefly recited, the present invention is a knife sharpener where the knife's orientation with respect to a pair of sharpening stones when drawn across the stones is fixed at a predetermined angle. The knife is free to be drawn across and down the surface of the stones, one side of the blade at a time, but remains at the predetermined angle throughout the sharpening process, even as the curved tip of a blade is drawn across the stones.

The device comprises a base supporting a frame that holds the stones at the preselected angle, and a guide rod held by the frame and which supports a knife clamp. The combination of the clamp, the guide rod and the frame enables the knife to move between the stones, forward and backward, and up and down but not about any axis through the knife itself. Therefore, the knife is prevented from rolling or yawing but can otherwise be moved freely within the range of motion dictated by the stones to the side and the length of the connection between the clamp and the guide rod. The predetermined angle between the stones and the blade of the knife can be adjusted and the device broken down for easy portability.

The sharpening stones are preferably formed to have a triangular cross section where the apexes of the angles are rounded. Each apex, or comer, has a different radius of curvature so that knives with serrations of different radii of curvature can be sharpened.

Finally, in an alternate preferred embodiment, the present knife sharpener can be hung from the underside of cabinetry in either a folded configuration for storage or an unfolded configuration for use.

An important feature of the present sharpener is the combination of the guide rod and the clamp that holds the knife to be sharpened. This combination allows a knife of almost any size to be moved against the sharpening stones and drawn across and down their faces but without the knife rotating about any axis through the knife; that is, the knife will not roll or yaw with respect to the stones. Thus, the angle between the knife and the stones' faces is held constant. Furthermore, control of the knife is a significant safety advantage.

Another important feature of the present invention is that the stones are free to swivel about their major axis while being held rigidly at the preselected angle by the frame. This allows the faces of the stones to remain engaged with the knife blade as the tip of the blade is pulled across the face because the stones rotate into the curve of the blade tip.

Still another feature of the present invention is that the stones are preferably formed to have triangular cross sections (although stones having any cross section can be used), thus creating three "corners" each of which is rounded and preferably with a different radius of curvature. By selecting the appropriate corner, serrations on a wide variety of different serrated knives can be sharpened.

Another important feature of the present invention is the alternative preferred embodiment that allows the present sharpener to be mounted to the underside of cabinetry in a foldable form so that it can be unfolded for use and refolded for storage. Also, the primary embodiment may conveniently be disassembled for storage or transportation. Thus the present invention is convenient as well as an effective sharpening tool for knives.

The present sharpener is also adjustable, in that the angle between the knife and stones may be changed and may be conveniently used by either a left handed or right handed person.

Other features and their advantages will be readily apparent to those skilled in the art of knife sharpeners from a careful reading of the Detailed Description of Preferred Embodiments accompanied by the following Drawings.

BRIEF DESCRIPTION OF THE DRAWINGS

In the Figures.

DETAILED DESCRIPTION OF PREFERRED EMBODIMENTS

Figure 1:
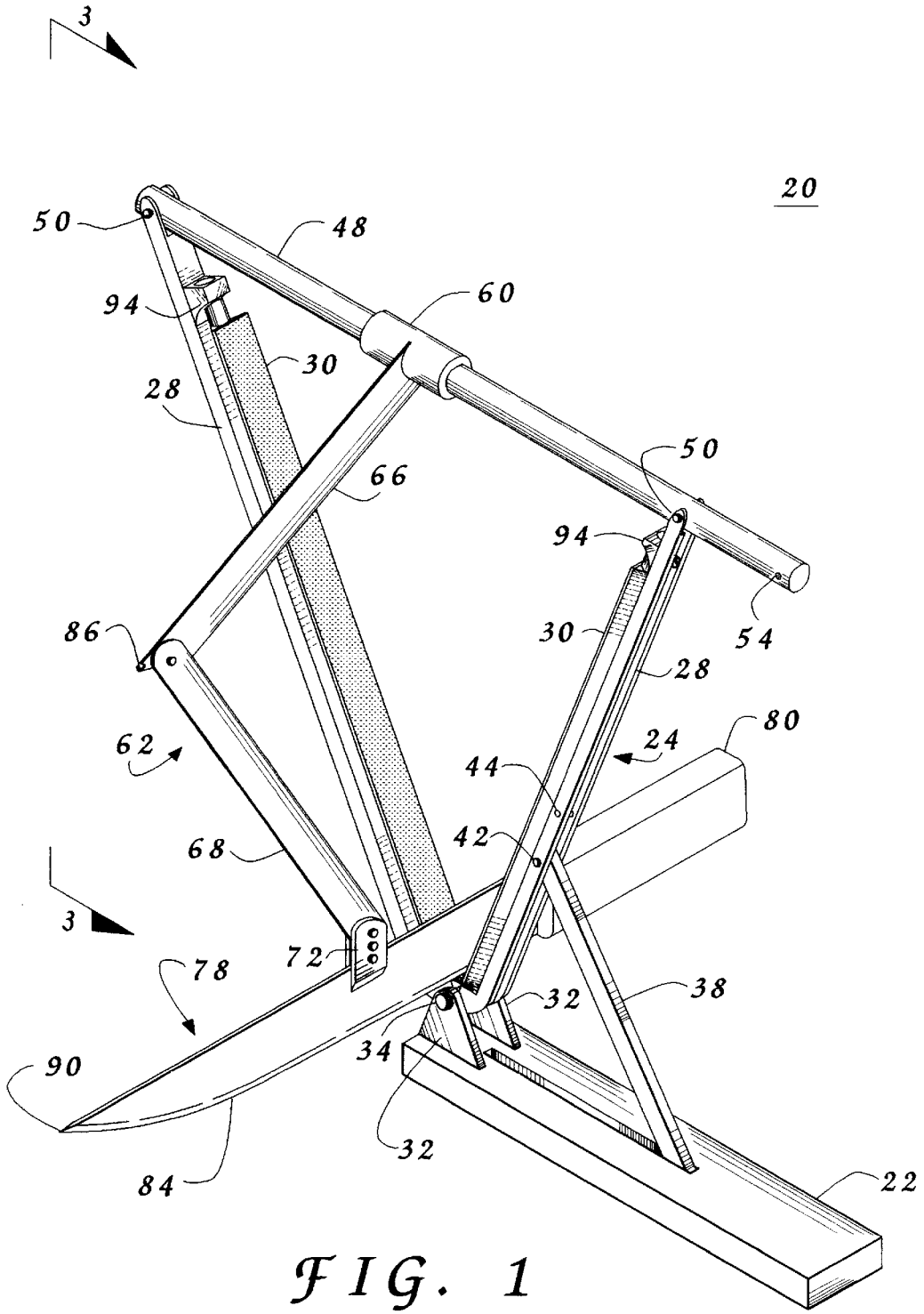
FIG. 1 shows a perspective view of a knife sharpener according to a preferred embodiment of the present invention.
Figure 2:
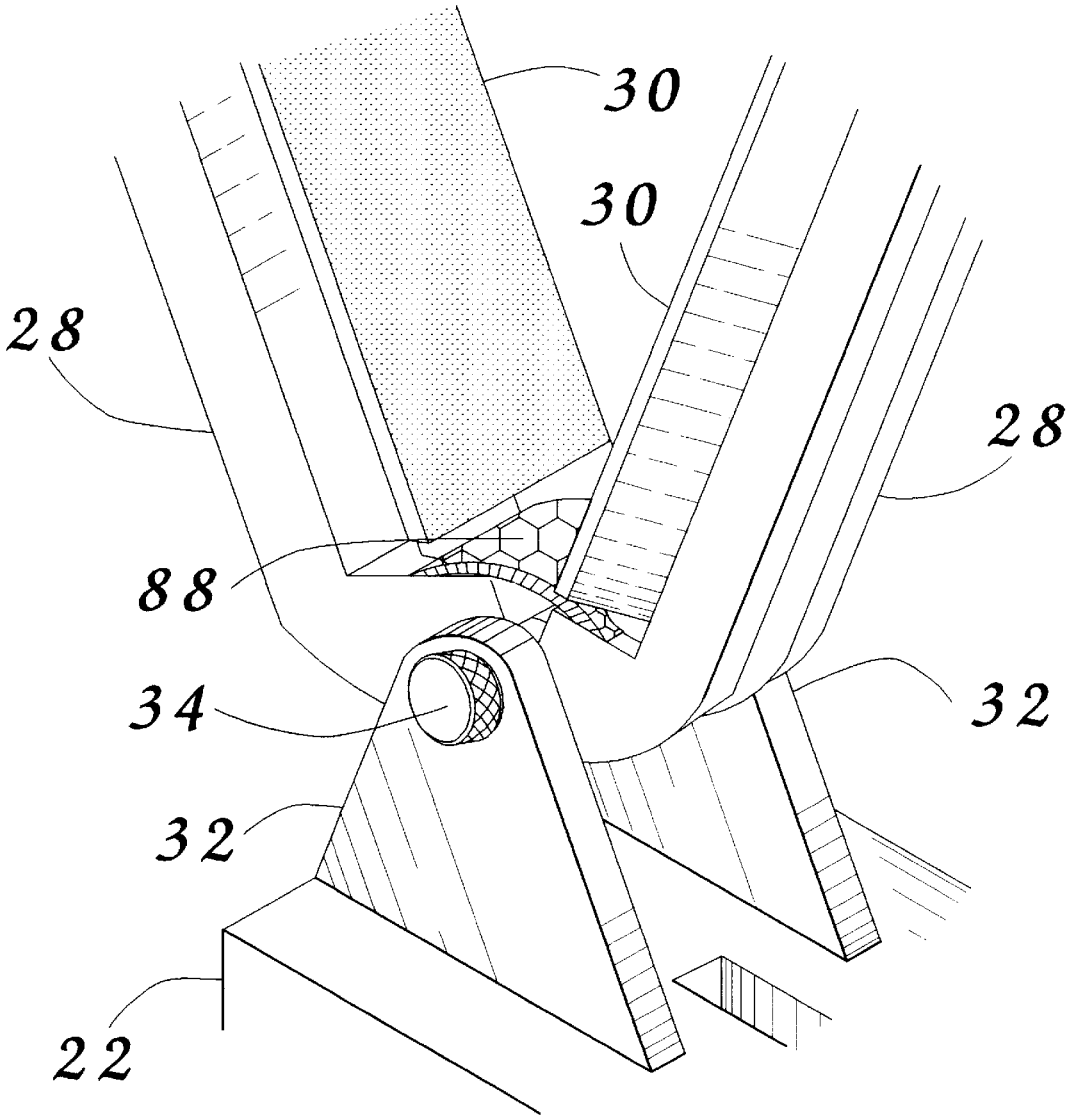
FIG. 2 is a left side view of the knife sharpener according to a preferred embodiment of the present inventions.
Figure 3:
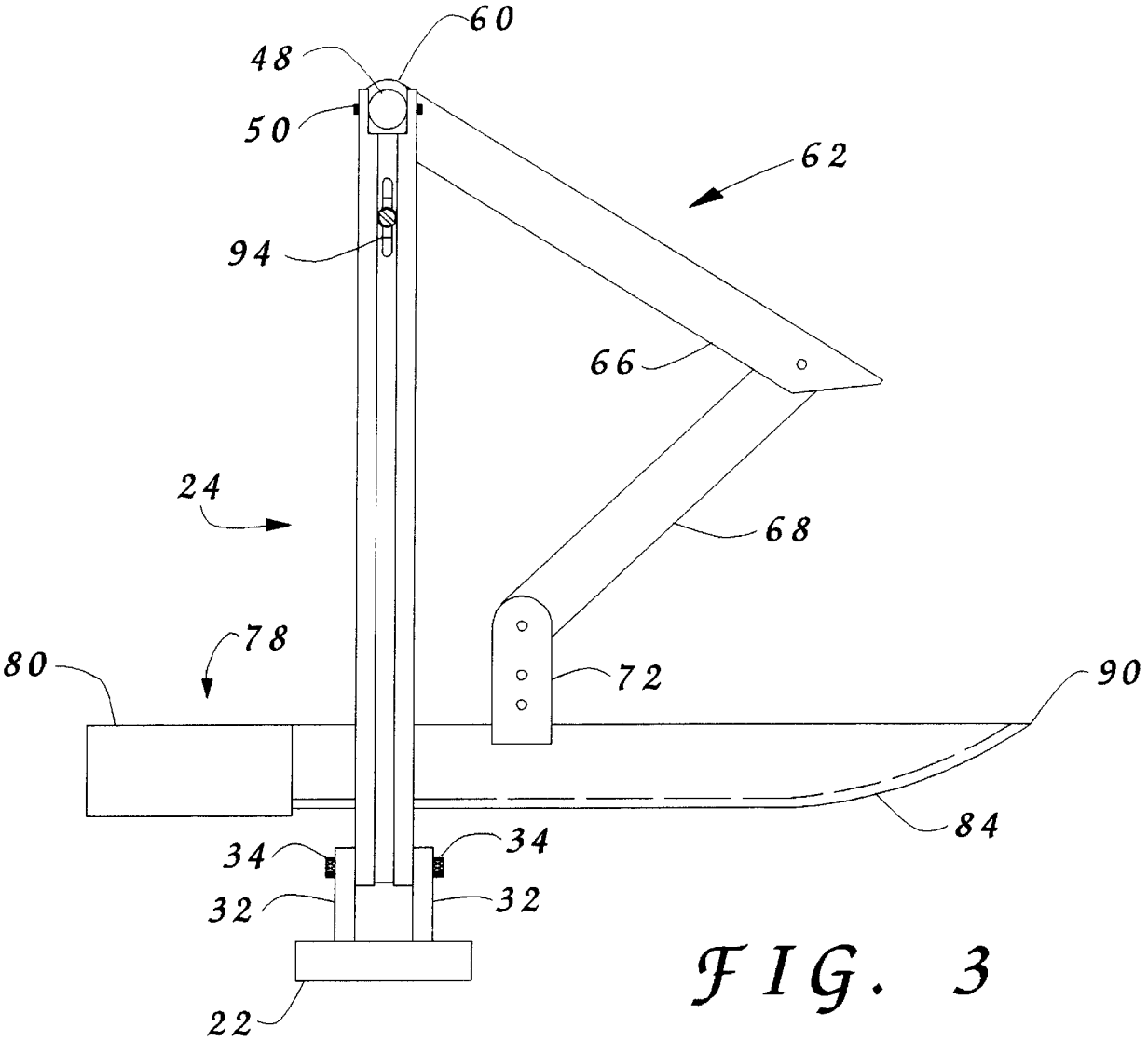
FIG. 3 is a right side view of the knife sharpener according to a preferred embodiment of the present invention.
Figure 4:
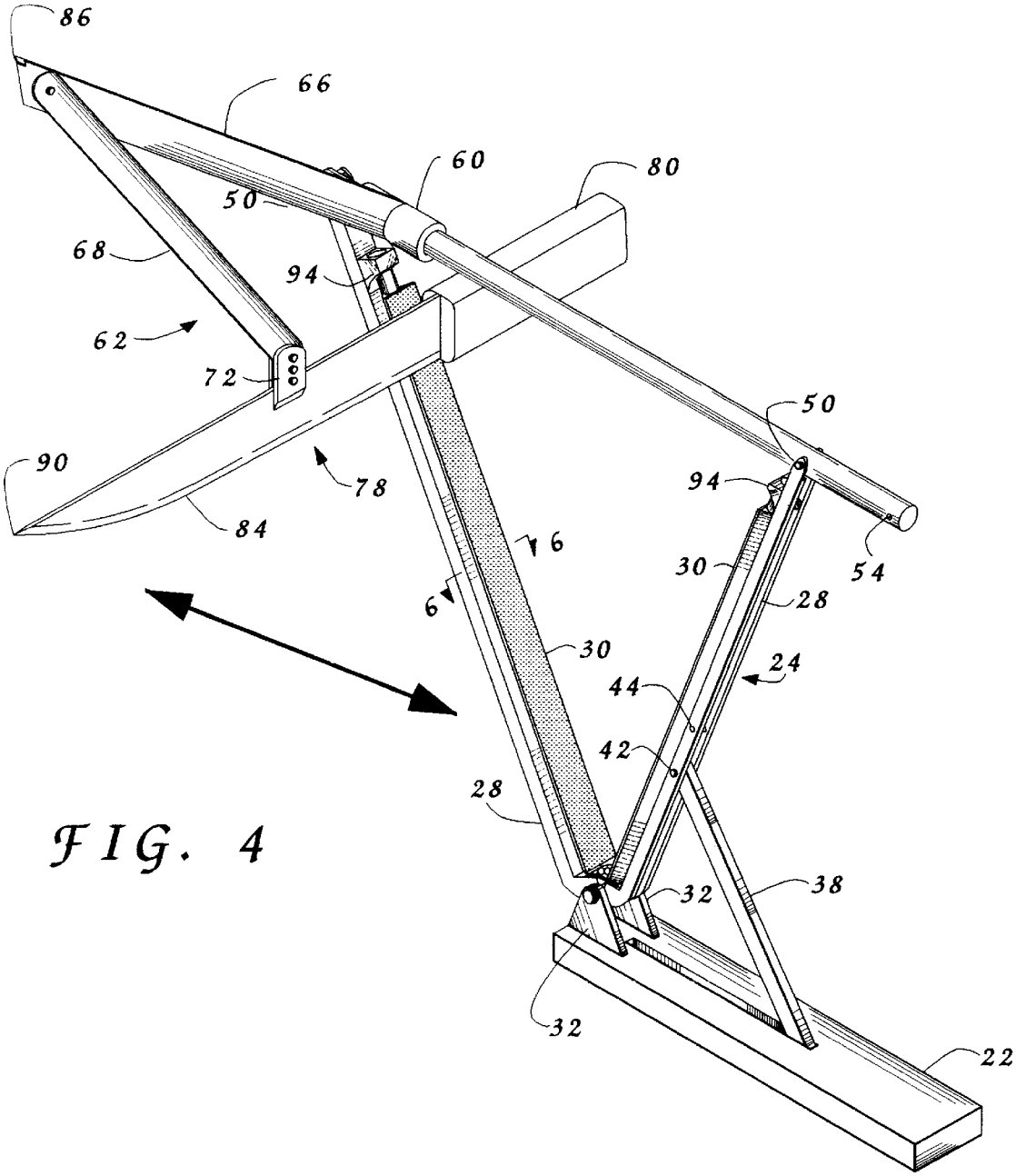
FIG. 4 is a perspective view of the present knife sharpener with the knife at the start of a stroke.

Referring now to FIGS. 1–4, the present invention is a knife sharpener, generally indicated by reference number 20. Sharpener 20 includes a base 22 and a frame 24 supported by base 22. Frame 24 includes two sharpening stone holders 28 and two sharpening stones 30. Holding stone holders 28 to base are two pivot knuckles 32 to which holders 28 are pivotally attached using a pivot pin 34. Also, a stabilizer arm 38 holds stone holders 28 in place on base 22.

Stabilizer arm 38, which is fastened to one of the two stone holders 28 using a pin 42 through one of several holes 44 in holder 28, allows the angle between holder's 28, and thus the angle between stones 30 and a knife to remain fixed unless changed. Different angles are possible and the adjustment to a different angle is made in part simply by removing pin 42 and reinserting it through a different hole 44.

Holding stone holders 28 at the predetermined angle is a guide rod 48, pivotally attached to one of the stone holders 28 and clipped to the other stone holder 28 using a clevis pin 50 through a hole 54 in the end of guide rod 48. Guide rod 48 thus spreads stone holders 28 and with them forms a triangle with its apex at the bottom and stone holders 28 extending from that apex to guide rod 48. The angle between stones 30 and the knife will be seen to be half of the angle of the apex of this triangle. To change the predetermined angle between the knife to be sharpened and stones 30, clevis pin 50 is removed, pivot pin 44 is removed, stone holders 28 are spread, and then pivot pin 44 is inserted into a different hole 44 and clevis pin 50 is inserted into a different hole 54. A preferred predetermined angle is 17.5 degrees.

A guide block 60 is carried by guide rod 48 so that it is free to slide along guide rod between stones 30. Guide block 60 carries a clamp assembly 62 that includes a pivot arm 66, a forearm 68 and a bracket 72. Bracket 72 is adapted to be fastened to a knife 78 and may be a universal bracket or a custom bracket that attaches to a particular brand of knife. A universal bracket 72 may clamp onto a handle 80 or blade 84 of knife 78. Preferably, clamp assembly 62 has an end stop 86 to prevent forearm 68 from overpivoting pivot arm 66.

Clamp assembly 62 with its pivot arm 66 and forearm 68 pivotally connected to each other allows bracket 72, and with it, knife 78, to be raised and lowered and moved forward and backward through stone holders 28 as far as clamp assembly 62 can reach. In combination with guide block 60 sliding on guide rod 48 and clamp assembly 62, bracket 72 can be moved between stones 30, up and down and back and forth. Bracket 72 clamps rigidly onto knife 78 so that knife cannot roll or yaw but can otherwise move with bracket 72. By rolling and yawing, it is meant that knife 78 cannot rotate about any axis running through it. In particular, rolling is rotating about an axis running through the long dimension of knife 78, and yawing is rotating about a vertical axis through knife 78.

When at rest, knife 78 fastened to bracket 72 may rest on a cushion 88 between stone holders 28. In use, knife 78 is grasped by its handle 80, lifted to the top of one of stone 30, moving it forward until the handle end of blade 84 is against stone 30. Then knife 78 is drawn toward user and downward so that the tip 90 of knife 78 reaches stone 30 as knife 78 crosses the bottom of stone 30. As knife 78 is moved down, it is held by bracket 72 in a vertical orientation against stone 30, which is inclined at the predetermined angle.

After stroking knife 78 against one stone 30; it is raised and stroked in a mirror image way against the opposing stone 30. This sequence is repeated until knife blade 84 is as sharp as desired.

Figure 5:
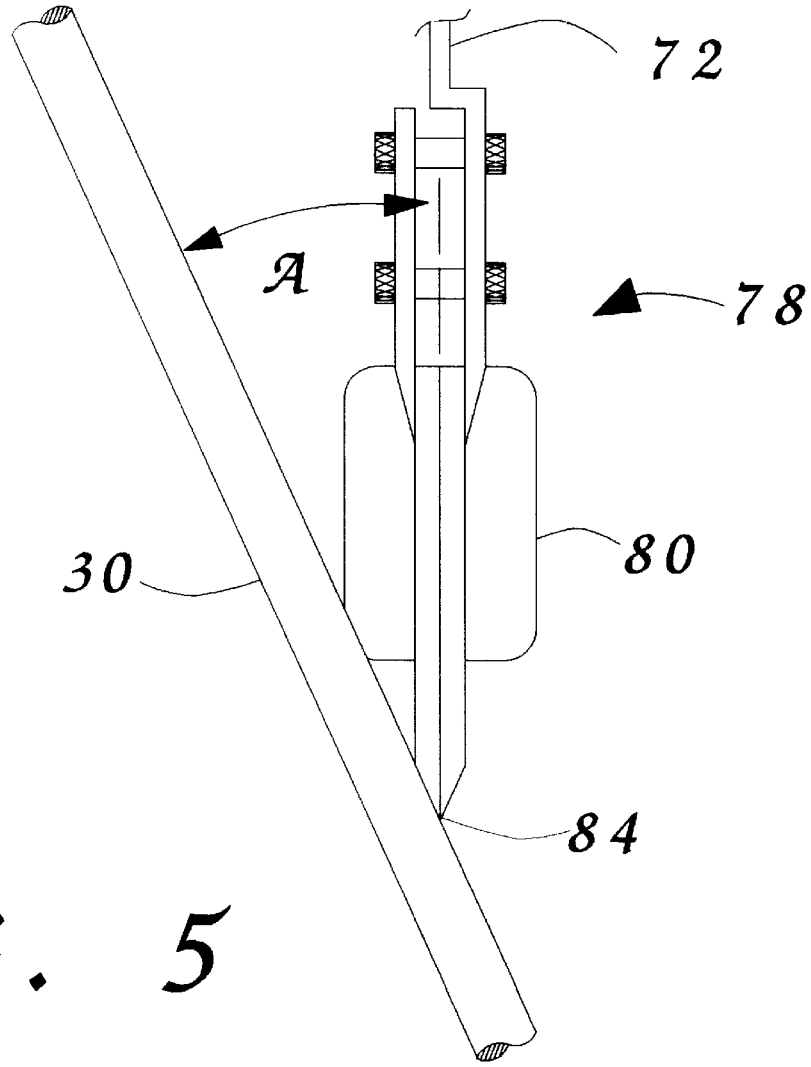
FIG. 5 is a detailed view of the blade of a knife in relation to a sharpening stone, according to a preferred embodiment of the present invention.

FIG. 5 illustrates the orientation of knife 78 with respect to a stone 30. Blade 84 engages the face of stone 30 and is held at a predetermined angle A throughout the stroke by bracket 72.

Stones 30 are generally elongate structures made of ceramic or stone material. Each is secured by a stone bracket 94 and corresponding slot on stone holders 28. Preferably, stones 30 are held by holders 94 so that they are free to pivot slightly about an axis parallel to their major dimension so that, as knife 78 is drawn across stones 30, blade 84 remains engaged against a face 98 of stone 30 throughout, including when tip 90 is curved. The curve of tip 90 would otherwise tend to separate from face 98. The term "face" means the exterior surface of stone 30, which may have a square, rectangular, round, oval or triangular cross section. Round or oval stones are preferred for putting a final hone on the edge of a knife blade because the blade will have nearly point contact with these stones. These stones preferably have a finer surface rather than a coarser surface.

Stone brackets 94 distribute the load on stones 30 when knife 78 is drawn across and down their faces 98. If thin round or flat stones are used, this load distribution may prevent undue stresses that could fracture the stone.

Figure 6:
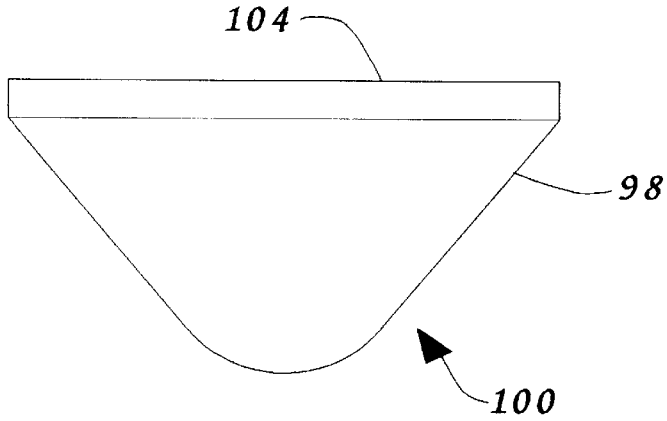
FIG. 6 is an end view of a sharpening stone, according to a preferred embodiment of the present invention.
Figure 7:
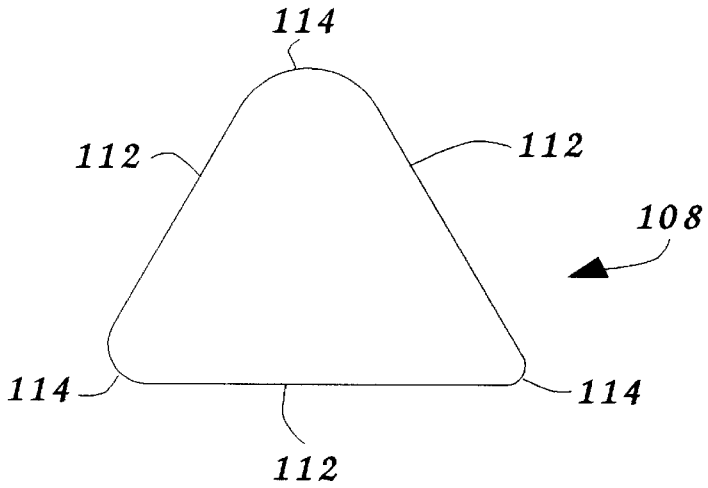
FIG. 7 is an end views of an alternative sharpening stone, according to a preferred embodiment of the present invention.

In a preferred embodiment, a stone 100 would have a flat side and a curved back to facilitate pivoting, as seen in FIG. 6. Stone 100 has a facet 104 against which knife 78 is drawn but is curved on the face opposite facet 104 to allow it to pivot easily. As a knife 78 is drawn across stone 100, facet 104 rotates so that it is fully engaged with blade 84 through to tip 90. In an alternate preferred embodiment, illustrated in FIG. 7, a stone 108 is shown having a triangular cross section with three facets 112 and three corners 114. A corner means the part of a face of a stone where two facets come together. Corners 114 preferably are rounded and each corner 114 has a different radius of curvature. This embodiment allows serrated knives to be sharpened by rotating the stone 108 until the corner 114 having the most appropriate radius of curvature is oriented inwardly so that a knife can be drawn across it. Also, the roughness of each facet 112 of a multi-faceted stone can be different, allowing for sharpening to take place more rapidly, for example, with a dull knife blade against a coarser stone facet.

Figure 8A:
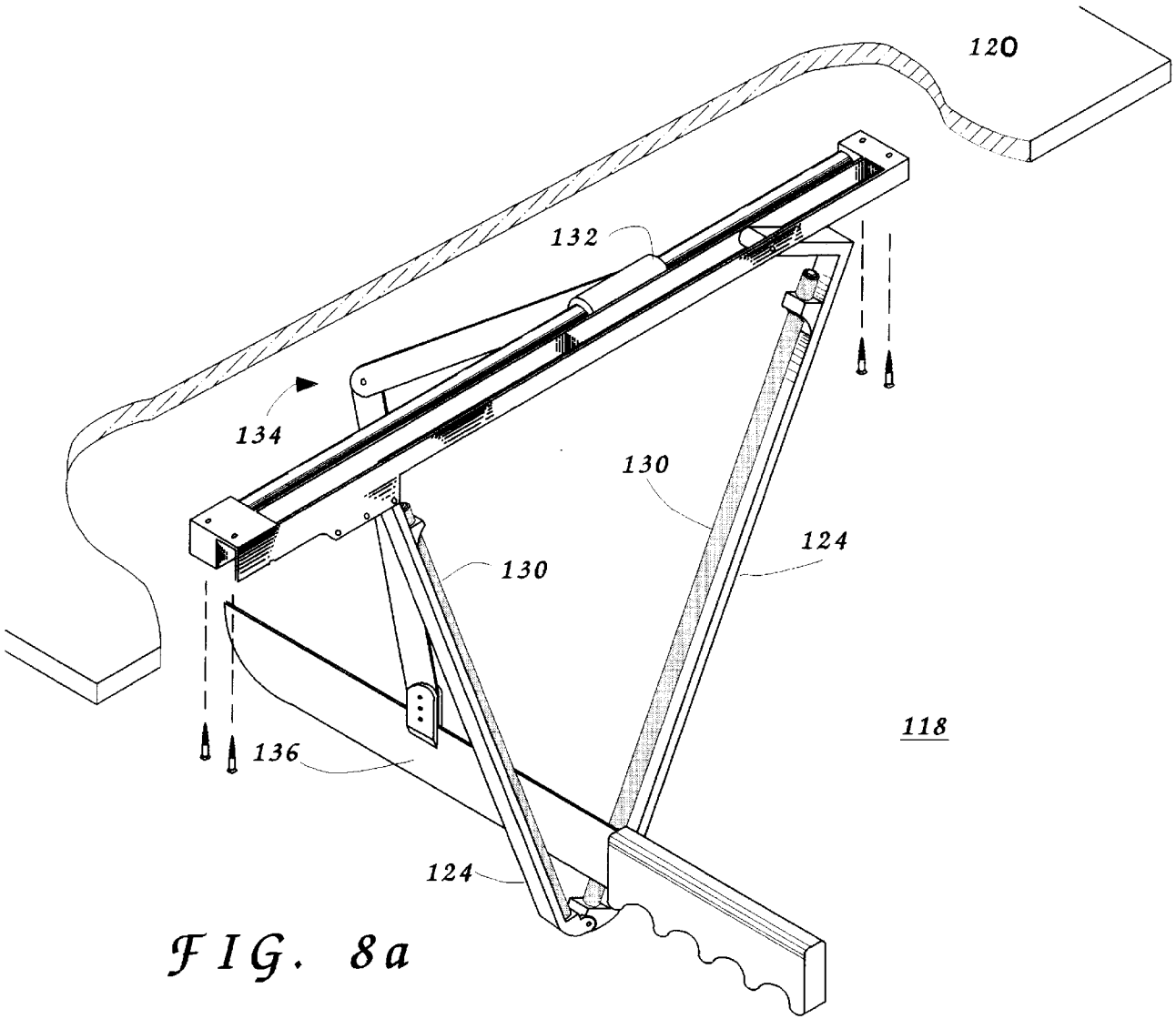
FIGS. 8A and 8B are side and top views of an alternative embodiment of the present knife sharpener.
Figure 8B:
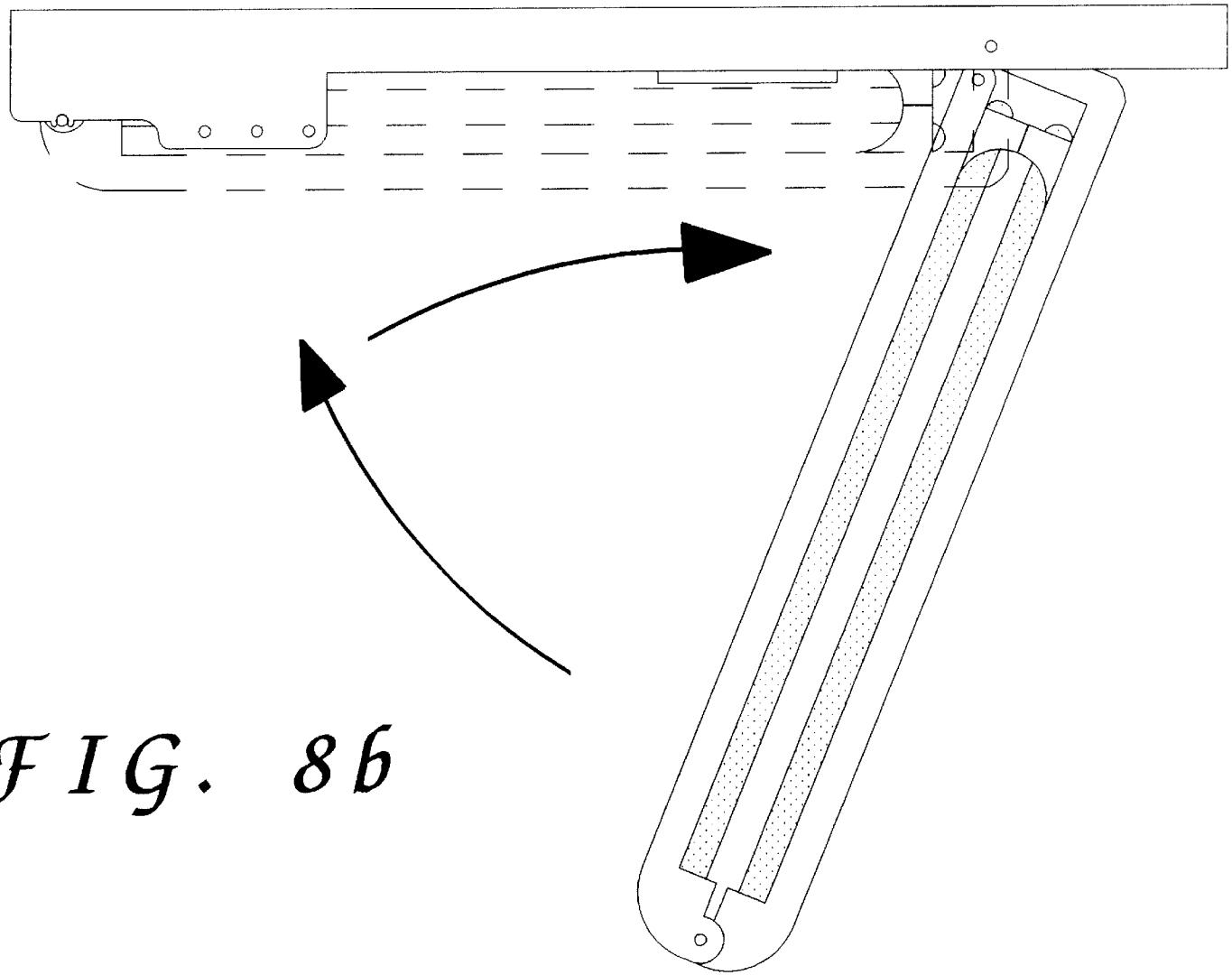

In the embodiment illustrated in FIGS. 8A and 8B, a sharpener 118 can be mounted to the underside of cabinetry 120. In this configuration, sharpener 118 is supported by cabinetry 120 in lieu of a base. Stone supports 124 are pivotally attached to a guide rod 126 that is suspended from cabinetry 120. Supports 124 hold stones 130 as in the embodiment described above. Similarly, a guide block 132 slides easily along guide rod 126 moving a clamp system 134 that secures a knife 136 and prevents it from rolling and yawing but otherwise allows knife 136 to move between stones 130 and to be moved up and down and forward and backward so that the blade of knife 136 can be drawn across and down the faces of stones 130.

The embodiment illustrated in FIGS. 8A and 8B may be folded compactly up against cabinetry 120 for storage and then unfolded for use. This embodiment saves space on counter tops by using the underside of cabinetry 120 as a firm support or base.

It will be apparent to those skilled in the art of knife sharpeners that many changes and substitutions can be made in the foregoing description of preferred embodiments without departing from the spirit and scope of the invention, defined by the appended claims.

What is claimed is:

1. A device for sharpening a knife, said device comprising:

a base;

two spaced-apart sharpening stones, each sharpening stone of said sharpening stones having a face;

first holding means carried by said base for holding said sharpening stones at a predetermined angle; and second holding means carried by said first holding means for holding and controlling a knife so that said knife is prevented from rolling or yawing but otherwise free to move so that said knife can be drawn against said sharpening stones at only said predetermined angle.

2. The device as recited in claim 1, wherein said first holding means includes a guide rod, and said second holding means is carried by said guide rod so that said second holding means is free to slide along said guide rod.

3. The device as recited in claim 1, wherein said first holding means includes a guide rod having an axis, and said second holding means is carried by said guide rod so that said second holding means is free to rotate about said axis of said guide rod.

4. The device as recited in claim 1, wherein said first holding means holds said sharpening stones at a predetermined angle with respect to said knife as said knife is moved across each stone of said sharpening stones.

5. The device as recited in claim 1, wherein said second holding means includes a clamp, and wherein said clamp is free to move toward and away from said first holding means.

6. The device as recited in claim 1, first holding means includes a guide rod having an axis and wherein said second holding means includes a clamp, said second holding means being carried by said first holding means so that said clamp is free to move in a direction perpendicular to the axis of said guide rod.

7. The device as recited in claim 1, wherein said first holding means is adjustable so that said predetermined angle can be changed.

8. The device as recited in claim 1, wherein said knife has a handle and wherein said second holding means holds said knife so that a user controls motion of said knife by said handle.

9. The device as recited in claim 1, wherein said sharpening stones are releasibly held by said first holding means.

10. The knife sharpening device as recited in claim 1, wherein each sharpening stone of said sharpening stones has at least one rounded corner.

11. The knife sharpening device as recited in claim 10, wherein said at least one rounded corner is at least two rounded corners.

12. The knife sharpening device as recited in claim 10, wherein each corner of said at least two rounder corners has a different radius of curvature.

13. The knife sharpening device as recited in claim 1, wherein said second holding means is foldable against said base.

14. A device for sharpening a knife, said device comprising:

a base;

a sharpening stone having a face;

first holding means carried by said base for holding said sharpening stone at a predetermined angle; and second holding means carried by said first holding means for holding and controlling a knife so that said knife is free to move but not to roll or yaw.

15. The device as recited in claim 14, wherein said second holding means is a clamp for releasibly securing a knife.

16. The device as recited in claim 14, wherein said second holding means is a clamp for releasibly securing a knife having a handle so that said knife can be moved by said handle.

17. The device as recited in claim 14, wherein said first holding means permits said sharpening stone to rotate as said knife, held by said second holding means, is drawn across said face of said sharpening stone.

18. The device as recited in claim 14, wherein said sharpening stone has more than one rounded comer.

19. A device for sharpening a knife, said device comprising:

a base;

two spaced-apart sharpening stones, each sharpening stone of said sharpening stones having a face;

first holding means carried by said base for holding said sharpening stones at a predetermined angle; and second holding means in spaced relation to said first holding means for holding and controlling a knife so that said knife is free to move but not roll or yaw.

20. The device as recited in claim 19, wherein first holding means is removably attached to said base.

21. The device as recited in claim 19, wherein said second holding means includes a pivoting clamp for releasibly holding a knife.

22. The device as recited in claim 19, wherein said first holding means includes a guide rod having an axis, and said second holding means is carried by said guide rod so that said second holding means is free to slide along said guide rod and rotate about said axis of said guide rod.

23. The device as recited in claim 19, wherein said sharpening stones are pivotally held by said first holding means.

* * * * *

UNITED STATES PATENT AND TRADEMARK OFFICE

CERTIFICATE OF CORRECTION

PATENT NO. : 6,168,509
DATED : January 2, 2001
INVENTOR(S) : S. Brock Presgrove

It is certified that error appears in the above-identified patent and that said Letters Patent is hereby corrected as shown below:

Column 2, line 26, change

"..., or comer,..." to "..., or corner,..."

Column 6, line 42, change

"...rounded comer." to "...rounded corner."

Signed and Sealed this

Fifteenth Day of May, 2001

Nicholas P. Godici

*Attest:*

NICHOLAS P. GODICI

*Attesting Officer*

*Acting Director of the United States Patent and Trademark Office*